US006367545B1

(12) United States Patent
Van Buskirk et al.

(10) Patent No.: US 6,367,545 B1
(45) Date of Patent: Apr. 9, 2002

(54) ELECTRONICALLY CONTROLLED ELECTRIC WIRELINE SETTING TOOL

(75) Inventors: Richard Van Buskirk, Waller; Rustom K. Mody, Bellaire; Darrin L. Willauer, The Woodlands, all of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/518,234

(22) Filed: Mar. 3, 2000

Related U.S. Application Data

(60) Provisional application No. 60/123,306, filed on Mar. 5, 1999.

(51) Int. Cl.[7] ..... E21B 43/12

(52) U.S. Cl. ..... 166/53; 166/66.4; 166/250.07; 166/250.15; 166/250.17

(58) Field of Search ..... 166/53, 66.4, 72, 166/250.01, 250.07, 250.15, 250.17, 264

(56) References Cited

U.S. PATENT DOCUMENTS 4,493,374 A 1/1985 Magee, Jr ..... 166/382
4,573,532 A * 3/1986 Blake
5,207,272 A 5/1993 Pringle et al. ..... 166/66
5,419,405 A * 5/1995 Patton
5,577,560 A 11/1996 Coronado et al. ..... 166/387
5,597,042 A * 1/1997 Tubel et al.
5,706,892 A * 1/1998 Aeschbacher et al.

FOREIGN PATENT DOCUMENTS

| | | |
|---|---|---|
| GB | 2 230 800 | 10/1990 |
| GB | 2 245 015 | 12/1991 |
| GB | 2 264 135 | 8/1993 |
| GB | 2 267 922 | 12/1993 |
| GB | 2 315 507 | 2/1998 |

* cited by examiner

*Primary Examiner*—Roger Schoeppel
(74) *Attorney, Agent, or Firm*—Cantor Colburn LLP

(57) ABSTRACT

An electric wireline setting tool includes a controller and a plurality of sensors sensing pressure, temperature, flow rate, current, etc. The controller communicates with the surface and or makes decisions downhole with regard to a motor and pump to tailor their activity to ensure that the tool being set is setting optimally.

16 Claims, 16 Drawing Sheets

ELECTRONICALLY CONTROLLED ELECTRIC WIRELINE SETTING TOOL

CROSS-REFERENCE TO RELATED APPLICATIONS

This application claims the benefit of U.S. Provisional Application Ser. No. 60/123,306 filed Mar. 5, 1999, which is incorporated herein by reference.

BACKGROUND OF THE INVENTION

1. Field of the Invention

The invention relates to the setting of downhole tools in a well. More particularly, the invention relates to an intelligent electric wireline setting tool having a plurality of sensors directed to sense parameters relevant to the setting of the tool to be set.

2. Prior Art

Electric wireline setting tools (EWST) have been known to at least the oil and gas industry for some time. A conventional EWST, however, is typically employed to set inflatable downhole apparatuses by receiving power from a power source and pumping wellbore fluids into the inflatable apparatus without any confirmation or sensory information. While the system is simple and works well in the great majority of cases, the only information that can be gained at the surface regarding the condition and operation of the system is a change in the current drawn from the power source. Typically, a current increase indicates a strain on the pump which is usually related to a filled inflatable tool. This is because as the pressure in the inflatable tool increases the motor will begin to stall. More current will be drawn to drive the stalled or stalling motor. Unfortunately, the change in current could also be due to other circumstances which cannot be distinguished at the surface.

The prior art, based upon the increased current draw, must conclude that the inflatable element is ready for deployment, providing all portions of the system, in fact, performed as they were supposed to, the inflatable tool would indeed be inflated and properly set.

Returning to other causes of current draw, a short may have occurred somewhere in the system, the motor or pump may have malfunctioned, the tool may have an occluded fluid passage, etc. Any one of these, or other factors, can cause a higher current draw. Since line current is the only indicator, the operator will determine the inflatable tool is set and pull the setting tool out of the hole. If the inflatable tool had not properly set then clearly the objective was not met. Moreover, it is not clear when the operator will know that the inflatable tool did not set. It could be right away or it could be somewhat later (maybe when the inflate crew has left the area). Time is lost and expense is incurred. Moreover, if the lack of proper setting of the inflatable tool is not immediately recognized, significant damage may be done to other components of the well; even more time and money can be lost. It is also possible, due to such occurrences as a lack of prime or a leak in the system that the current never increases. While this does not provide an erroneous "set" indication it is still problematic because there is no indication as to what is happening downhole. The art therefore is in need of a setting tool which provides real time information about the condition of the inflatable tool and the condition of the setting tool to ensure a proper setting procedure is taking place and to enable corrective action if the setting procedure has gone awry.

SUMMARY OF THE INVENTION

The above-identified drawbacks of the prior art are overcome or alleviated by the intelligent electric wireline setting tool of the invention.

The intelligent EWST incorporates a controller and at least one, preferably several, sensor(s) to sense such parameters as voltage and current flowing to motors, direction of movement of the motors, speed of the motors, pressure (element pressure, wellbore pressure, downhole and uphole thereof), temperature, flow rate, or any other parameter associated with the downhole environment and setting of the tool. All of these parameters are communicable directly to the surface due to the inclusion of a communication function through the controller located in the immediate vicinity of the EWST. Based upon the information obtained, adjustments to the setting process may be made to optimize the same. Adjustments include changing current and/or voltage to assure appropriate power downhole, and determining and making appropriate inflation fluid pressure and inflation fluid volume changes taking into account thermal expansion of fluid in the downhole environment. Adjustments may be made by the operator, by a surface computer or a downhole computer as desired and equipped. Corrective measures can be made in real time to avoid loss of time or money.

BRIEF DESCRIPTION OF THE DRAWINGS

Referring now to the drawings wherein like elements are numbered alike in the several FIGURES.

DETAILED DESCRIPTION OF THE INVENTION

Figure 1:
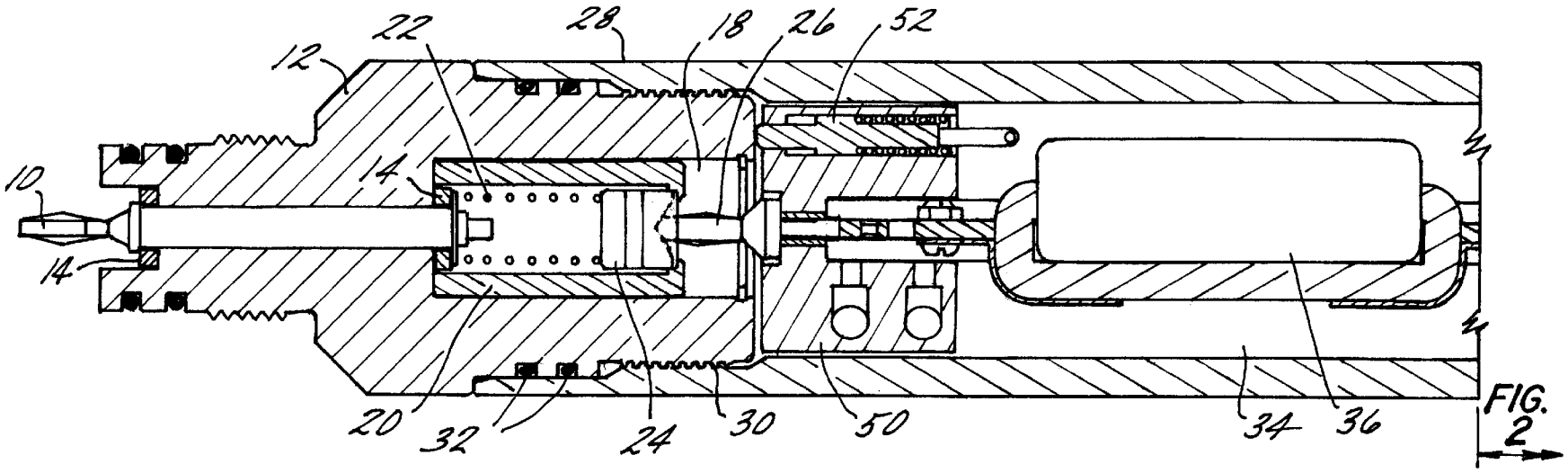
FIGS. 1–15 are an elongation cross section view of one embodiment of the invention.
Figure 2:
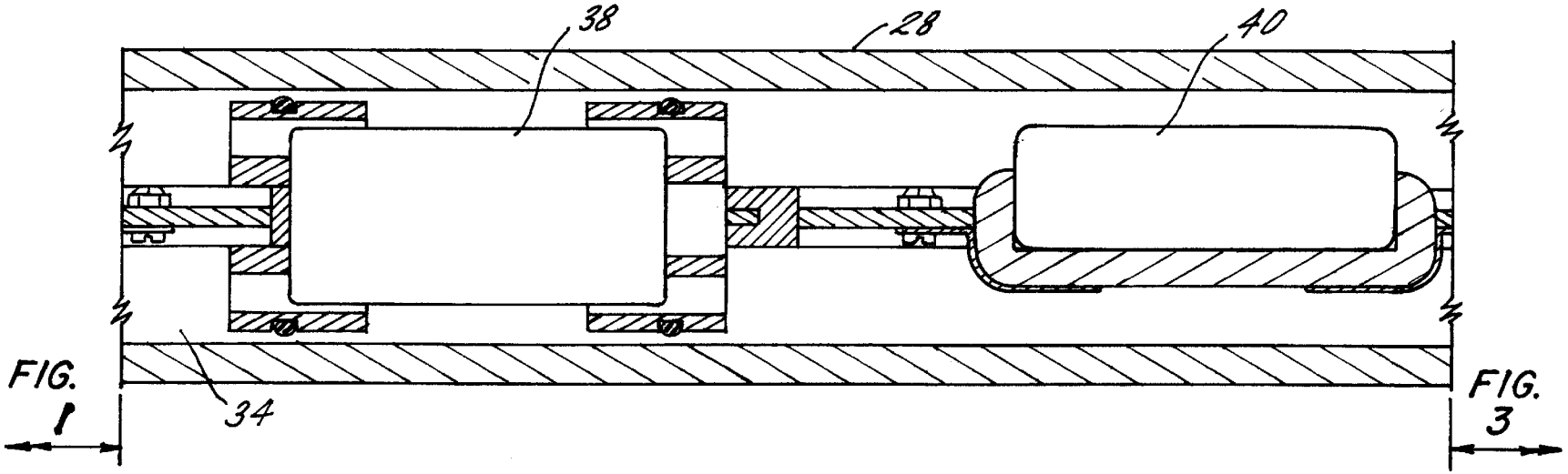
Figure 3:
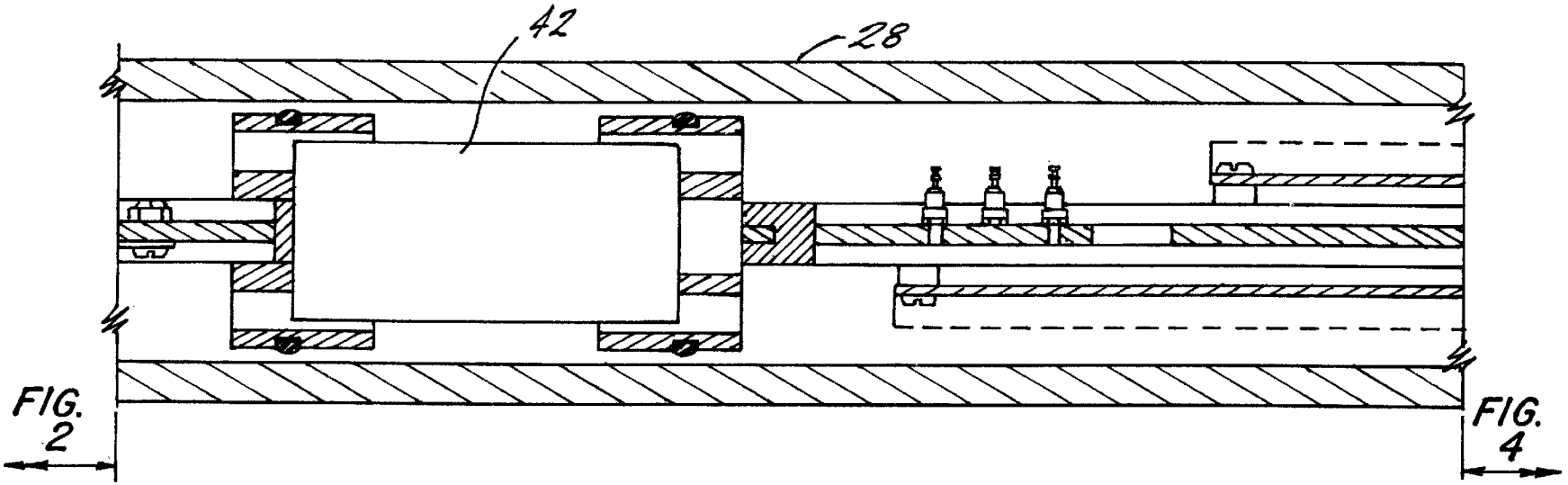
Figure 4:
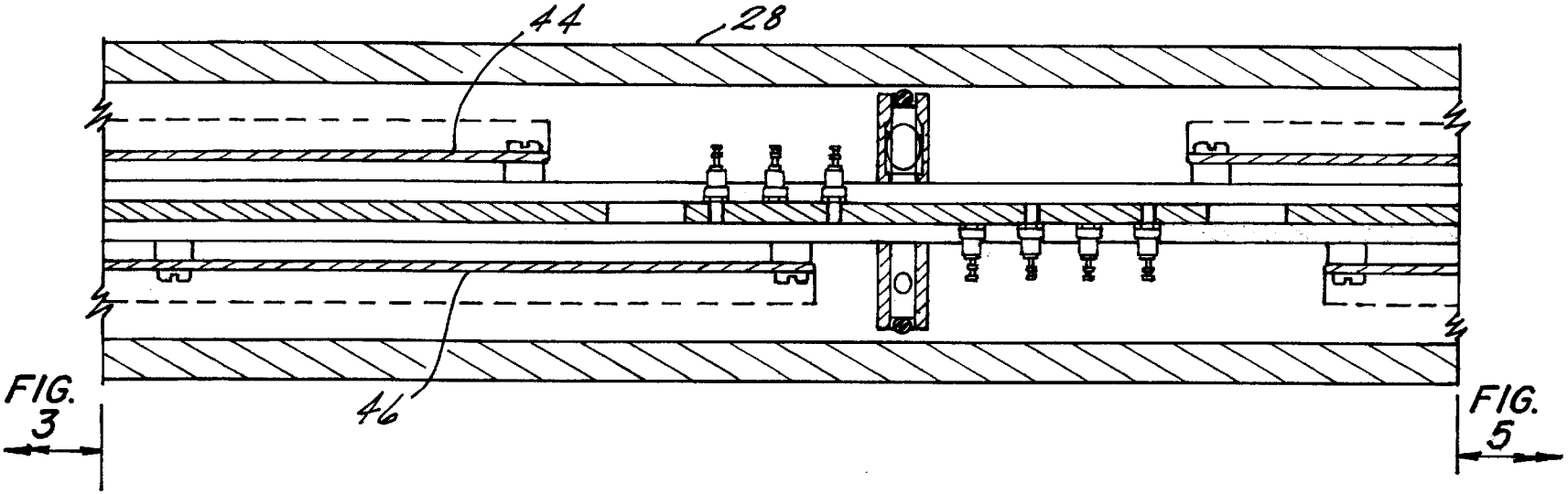
Figure 5:
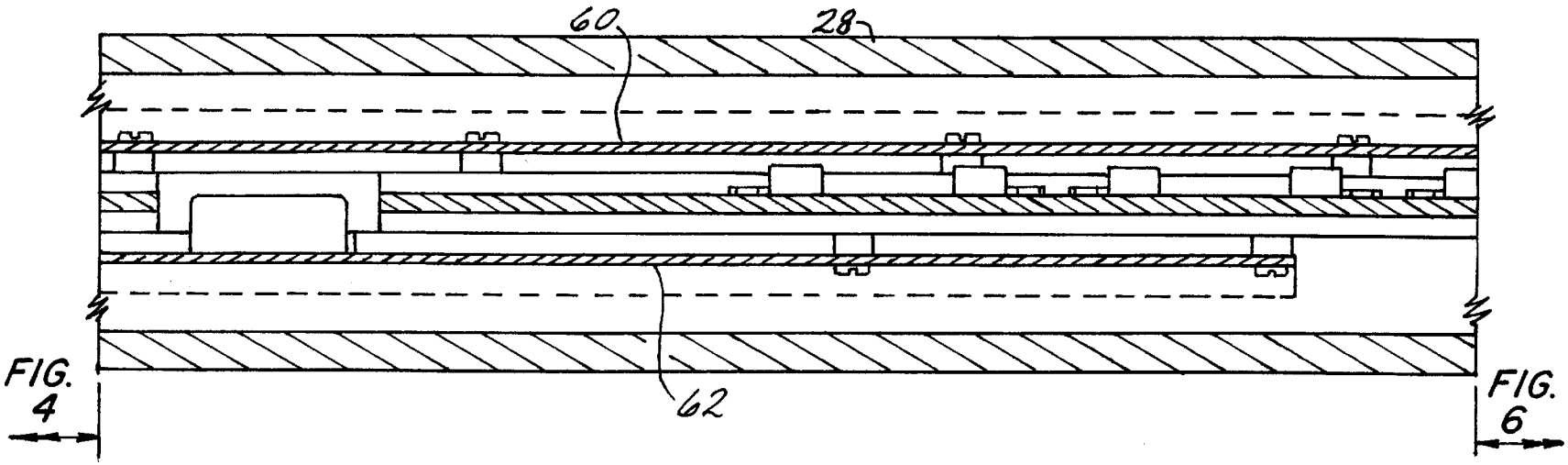
Figure 15:
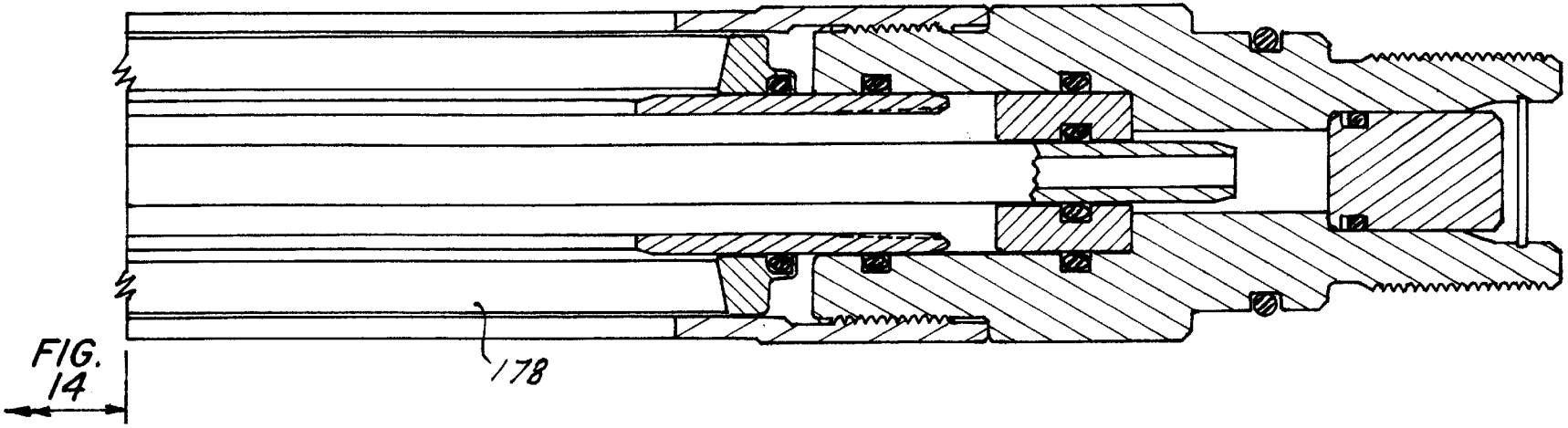

Referring to FIG. 1 and beginning with the uphole end of the tool, the following discussion will progress through the figures to FIG. 15 at the downhole end of the tool. It will be understood that the downhole end of the Electric Wireline Setting tool of the invention is to be connected to the downhole tool to be set.

FIG. 1 illustrates the uphole end of the setting tool of the invention wherein a Banana plug 10 is mounted in a collar locator adapter 12 with insulating washers 14 and a female spacer 16 to bring the connection into a spring biased contact block chamber 18. Chamber 18 contains an insulator 20 to prevent contact between the central conductor and the outer conductor. Spring 22 biases contact block 24 in a direction against compression of spring 22 which occurs upon connection with the telemetry portion of the tool discussed hereunder. Contact block 24 makes connection with second Banana plug 26. Collar locator adapter 12 fits within telemetry housing 28 by threaded connection 30 and is sealed with O-rings 32.

Power and signal are transmitted to the telemetry sub 34 through pin/spring contact assembly 50. Contact assembly 50 includes central Banana plug 26 for the negative connection and offset spring probe connector 52 for the positive connection. The positive and negative connection points are reversed from many conventional downhole tools to enable the use of conventional gamma tools without affecting the setting tool of the invention since the setting tool does not "run positive".

A telemetry sub 34 is constructed from commercially available parts to provide communication with remote intelligence or at the surface as desired and includes a transformer 36 connected to a first filter cap 38 which is connected to a choke 40 connected to a second filter cap 42. These components are connected operably to an analog to digital converter 44 and processor/telemetry printed circuit board (PCB) 46 which process analog signals from sensors into digital format to transmit and receive information, respectively. More particularly, the analog/digital (A/D) converter 44 is connected to sensors discussed hereunder that generate analog signals in response to specific stimuli. Elements 46 or 44 or both combined may be considered a controller.

When the analog signal is received by the A/D converter 44, the signal is processed and noise removed before a digital signal is communicated to the processor/telemetry PCB 46 where the signal is piggy backed as an AC frequency signal on a DC line to the surface or other remote location.

Downhole of telemetry PCB 46 and operably connected thereto are motor driver PCB assembly 60 and power supply PCB assembly 62. The motor driver PCB 60 is a commercially available controller for a brushless motor (which is preferred in this tool) and directs the winding firing sequence of the motor. The activating of a selector switch at the surface (not shown) changes the direction of the motor to obtain two speeds/torque multiplication conditions. The two speed/torque multiplication capability of the motor is a known concept, the parts for which are commercially available.

Power supply PCB assembly 62 receives power at preferably 160 volts DC and regulates that power to a cleaner 160 volts DC for the motor and 5–10 volts for the electrics in the tool. These are common in the industry and will be understood by one of skill in the art.

Figure 6:
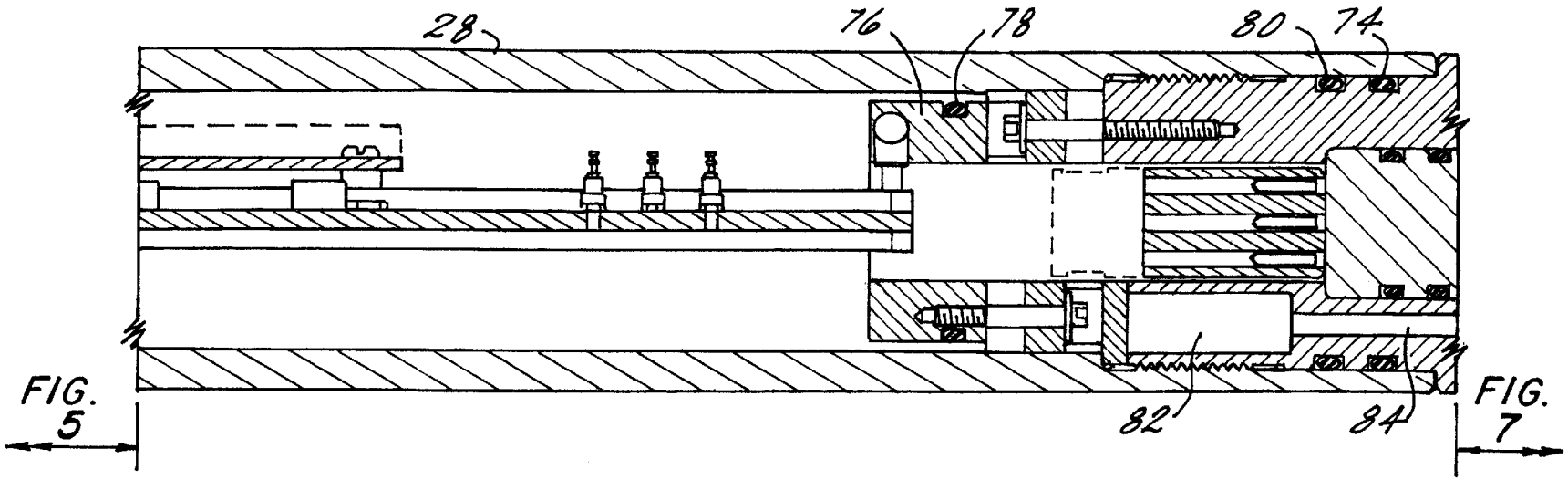
Figure 7:
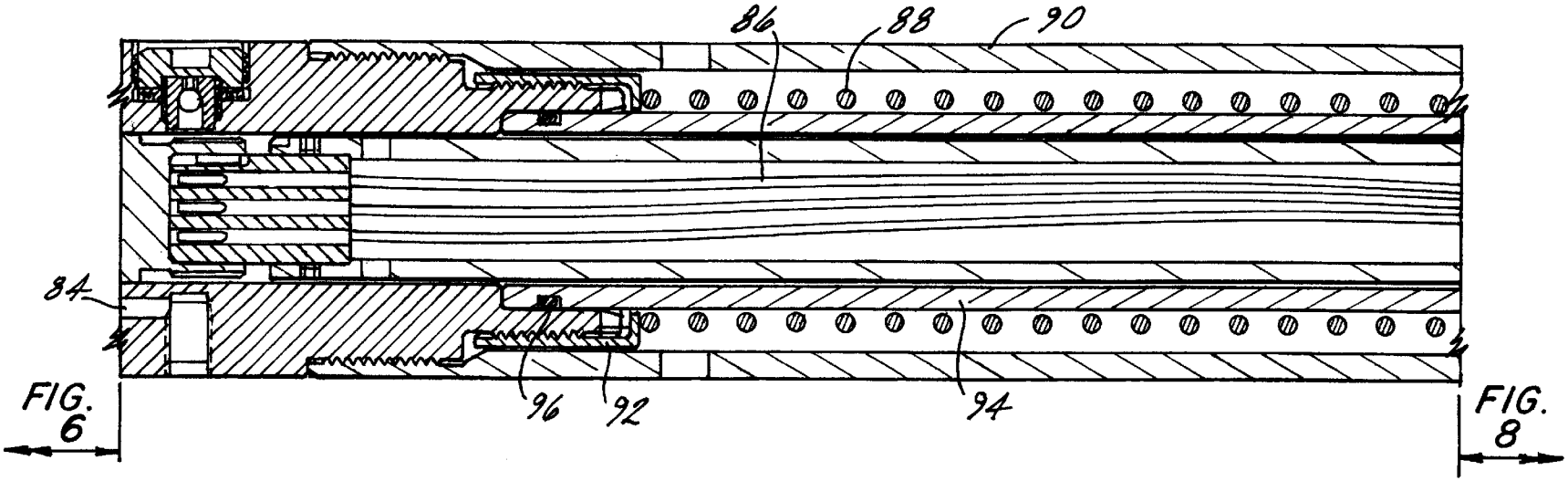
Figure 8:
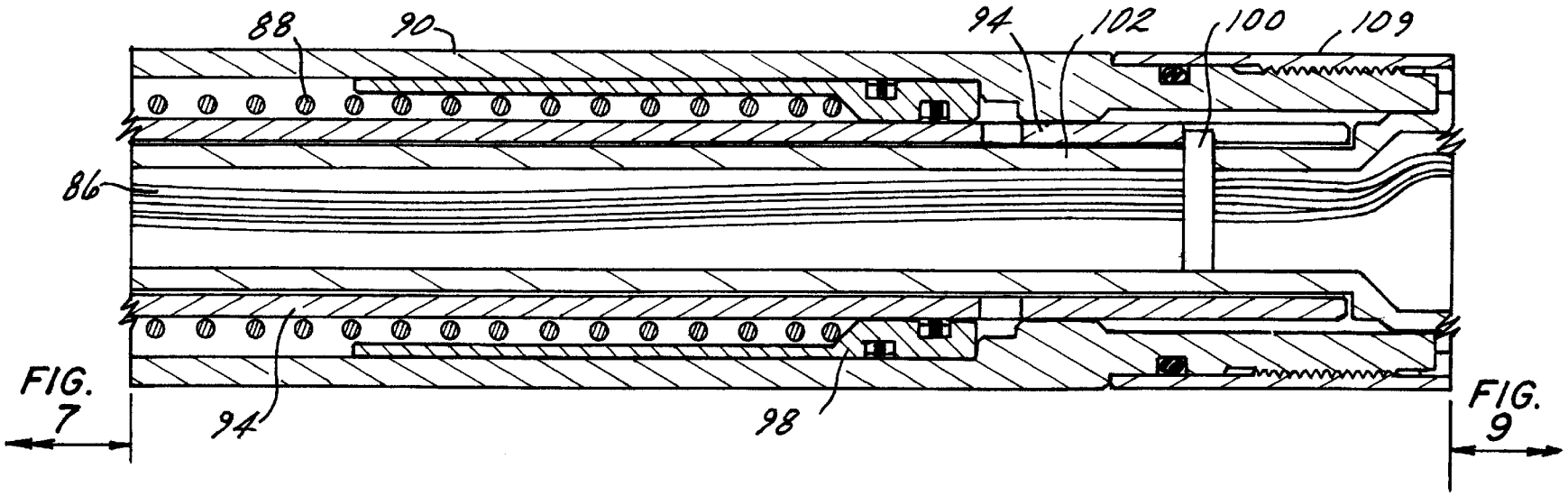

Telemetry housing 28, referring now to FIG. 6, is threadedly connected to top sub 70 at thread 72 and sealed thereto with O-rings 74. It should be noted that at either end of the telemetry and electronics components discussed is a chassis mount. The uphole side 50 was noted earlier and the downhole compliment thereto is mount 76 illustrated in FIG. 6. Mount 76 includes preferably o-ring 78 to seal against housing 28. The mounts 50 and 76 locate and maintain the electrics in position.

The telemetry and control electronics from within telemetry housing 28 are connected to the drive components beyond the compensating piston housing through top sub 70 and a high pressure connector 80. The connectors are common in the art.

It should be noted that an ambient pressure sensor is preferably mounted in sensor recess 82 in top sub 70. Sensor recess 82 is open to environmental pressure through conduit 84 and is useful in the invention to monitor the well pressure.

Other sensors that may be employed to provide information to the controller circuits are temperature sensors in both internal fluid and/or wellbore fluid, inflation pressure, current and voltage sensors at the tool (to enable the determination of whether anomalous readings are caused by the tool or the wireline), etc.

From high pressure connector 80, conductors 86 travel through compensating piston housing 90 to terminate at the resolver assembly and motor.

The compensating piston housing 90 includes a spring 88 bounded at its uphole end by mandrel cap 92 which is threadedly attached to top sub 70. In the same general location, the upper end of compensating piston mandrel 94 is visible nesting within top sub 70 and sealed there with o-rings 96. At the downhole end of compensation piston housing 90, compensating piston 98 rests in the lowest ambient pressure condition.

An important feature of the invention is torque pin 100 which is a component of an alignment system maintaining alignment of the pins of the high pressure connector 80. Torque pin 100 locks mandrel 94 to motor cap 102 so that relative rotation between mandrel 94 and motor cap 102 does not occur.

Figure 9:
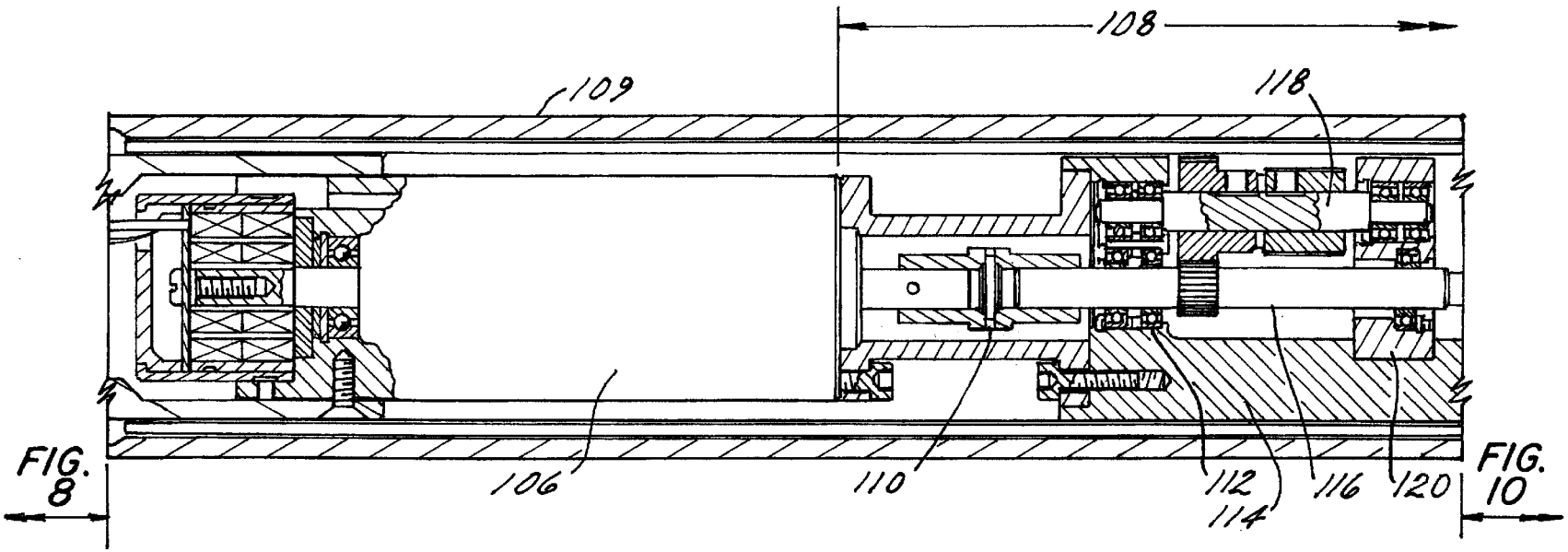

Within motor cap 102 is positioned resolver 104. This is a commercially available part and functions to provide information about the position of the shaft of the motor. The information is provided to the motor driver PCB 60 discussed hereinabove. Resolver 104 is also attached to motor 106 (FIG. 9) which is operably connected to geartrain 108. The geartrain employed in this embodiment of the invention is of a standard makeup responsive to two directions and complementary torques. The two speeds torques are created by reversing the direction of the motor. This is accomplished at the surface using a remote switch (not shown). For clarity, the gear train includes multijaw coupling 110; bearing 112; gear body 114; input shaft 116; reduction clutch shaft 118; pillow block 120; roller clutch 122; needle bearing 124 and gear 126 all of which, as stated, are known to the art. Since even with the geartrain, the end drive result is too fast for the desired result in the invention, a planetary gearhead 128 is desirable. Planetary gearhead 128 is preferably operably connected to a spider coupling 130 which serves to couple planetary gearhead 128 to secondary drive shaft 132 which is supported at its downhole end by bearings 134 mounted in sensor housing 136 which is fastened to motor cap 102 and trapped in the motor housing 109 at the downhole end by coupling sub 138 (FIG. 11) attached to motor housing 109 by thread 140. O-rings are supplied at 142 for their customary purpose.

Figure 16:
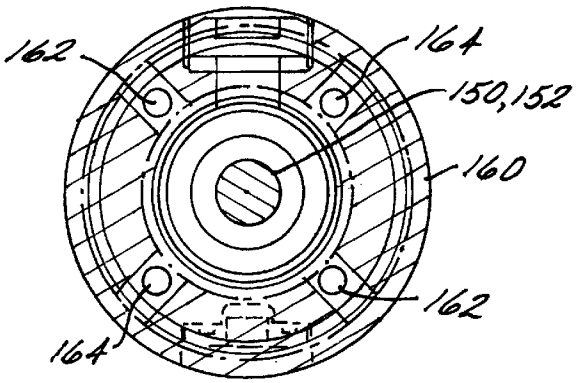
FIG. 16 is a cross section view of the invention taken along section line 16—16 on FIG. 11.

Transition sub 144 is a floating sub which is annular and defines an annular fluid passage for pressurized fluid to reach the pressure transducer 146 mounted in sensor housing 136. The transducer monitors the high pressure fluid leaving the pump to determine the pressure in the inflatable element. Shaft union 148 couples with drive shaft 150 as the parts are assembled. Drive shaft 150 is supported by a series of bearings, spacers and seals, as is known to the art, and at the end of shaft 150 a pump 152 as known from the prior art in U.S. Pat. No. 5,577,560 which is assigned to the assignee hereof and incorporated herein by reference and from a commercially available product (part #437140002) available from Baker Oil Tools, Houston, Tex.

Where secondary drive shaft 132 joins drive shaft 150, the pump housing 160 joins sub 138 by threaded junction 158. Within pump housing 160 are several bore holes, best seen in cross section FIG. 16 taken along section line 16—16 in FIG. 11. The high pressure ports to the transducer 146 are identified as numeral 162 and the low pressure inlet ports providing inlet fluid to the pump are identified as numeral 164.

Figure 10:
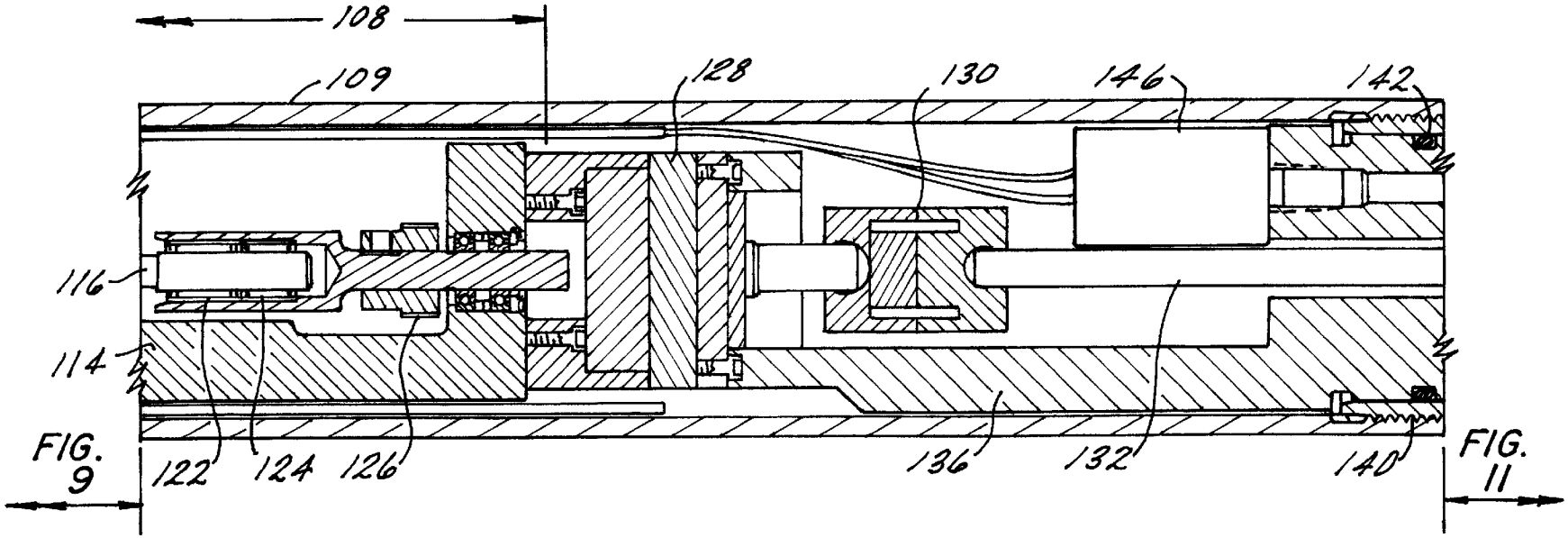
Figure 11:
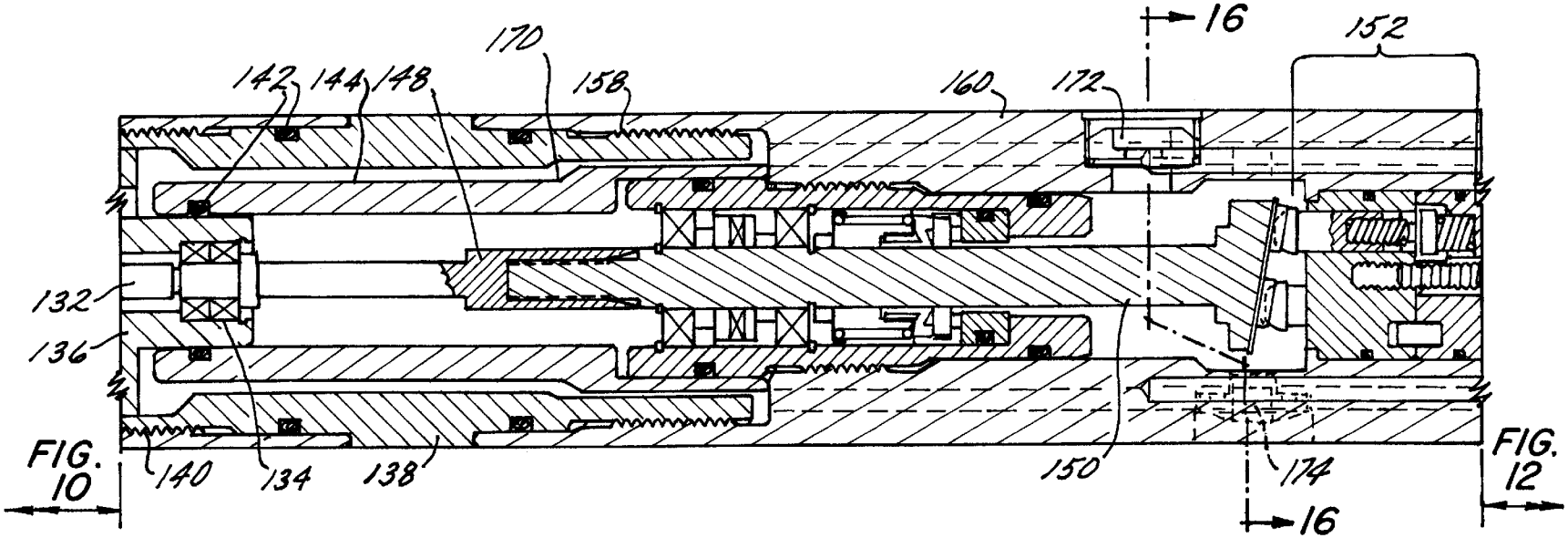
Figure 12:
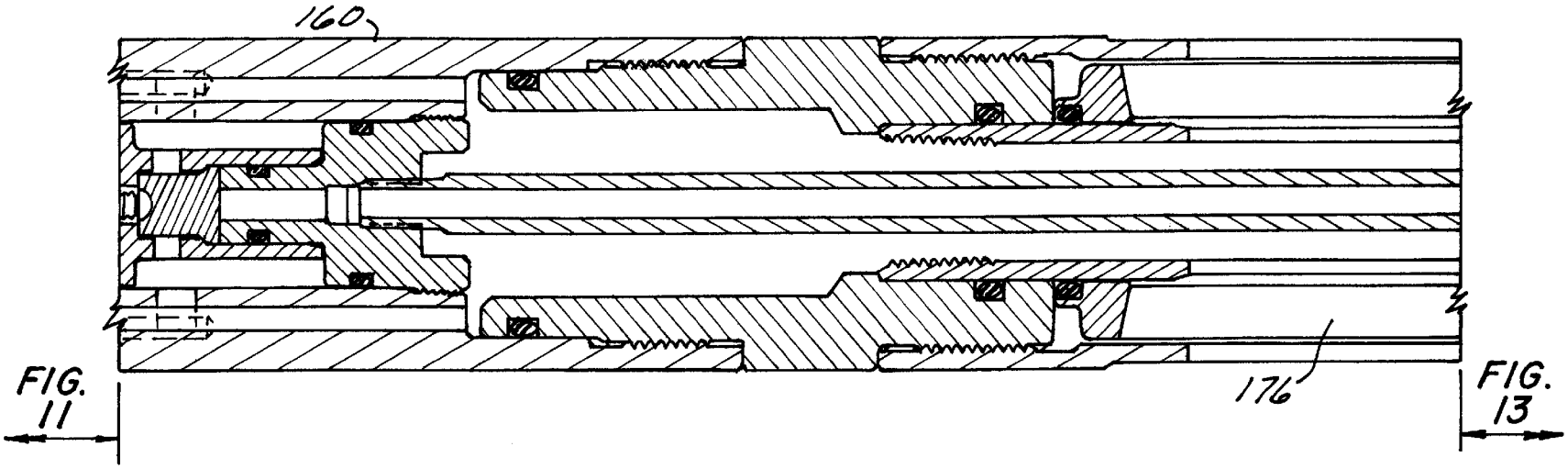
Figure 13:
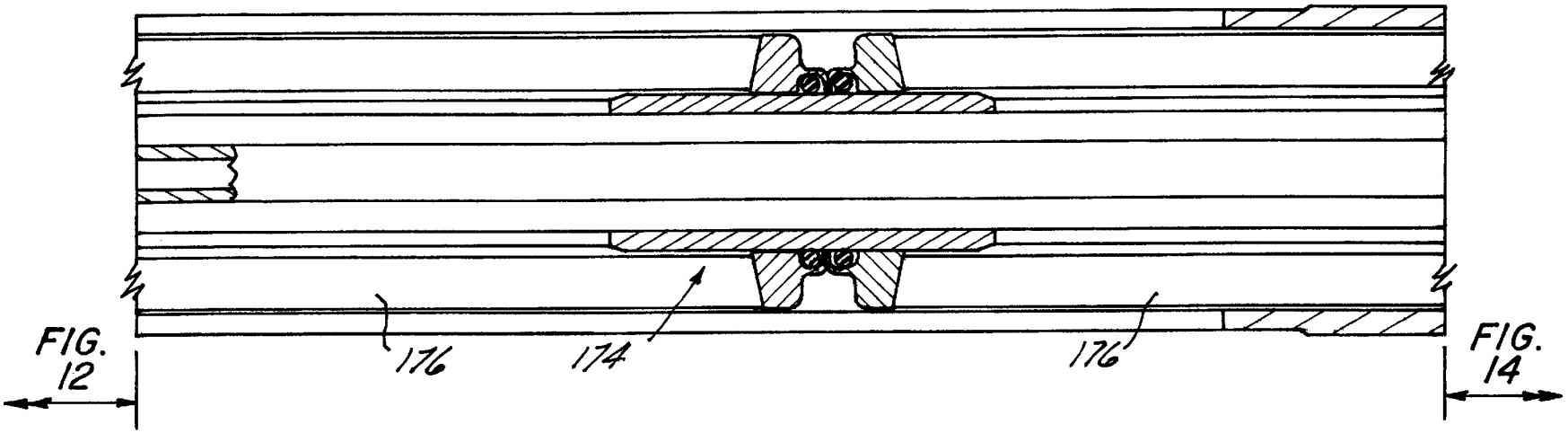
Figure 14:
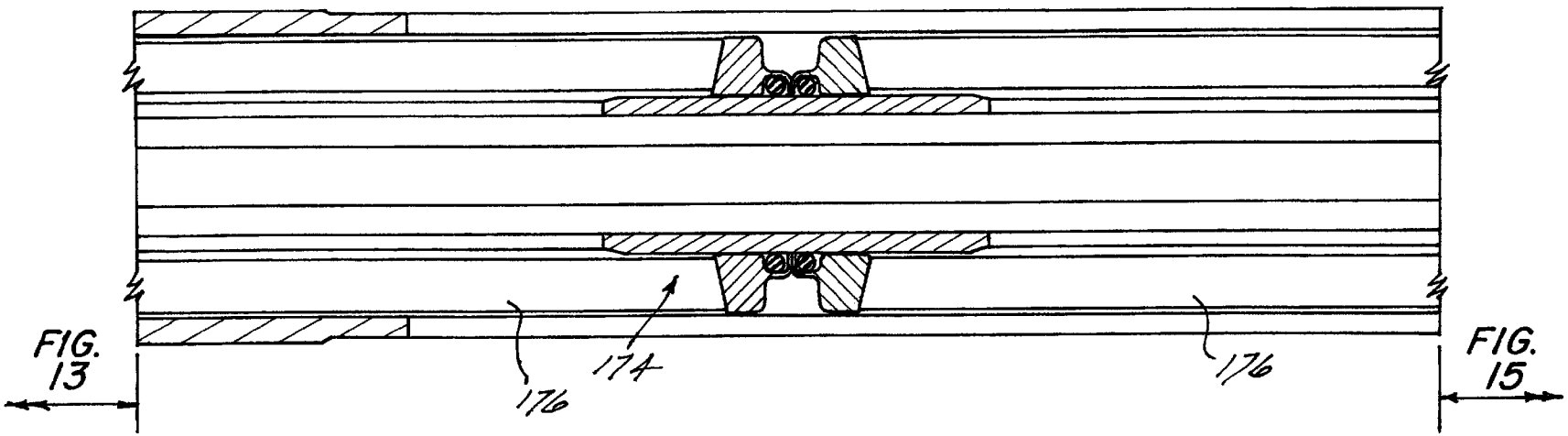
Figure 17:
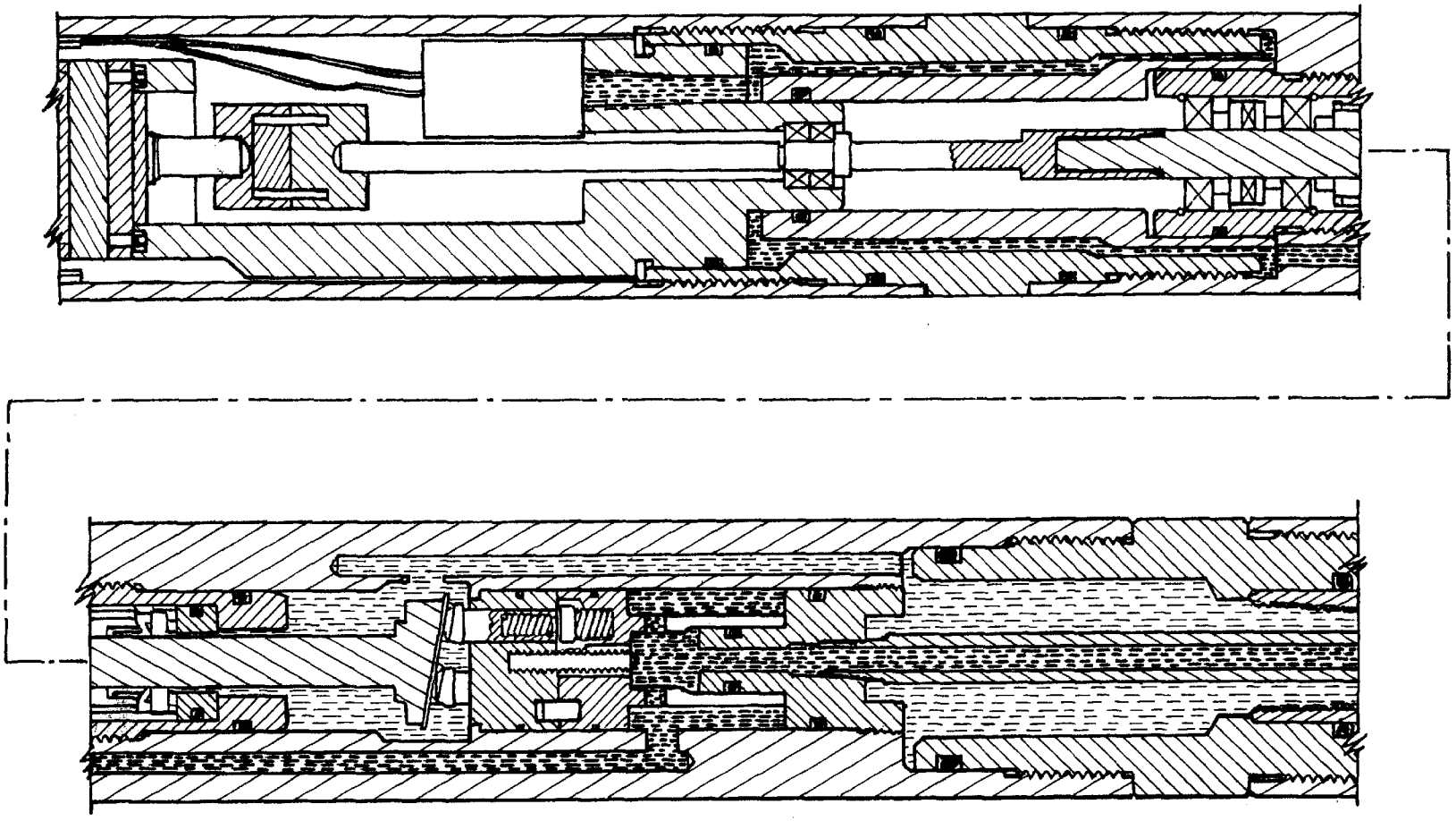
FIG. 17 is a second view of the invention with tight x-hatching to show the high pressure flow path through the tool.

In FIG. 17, the high pressure pathway (pump outlet fluid pathway) has been tightly x-hatched in the drawing of the portion of the tool which extends through FIGS. 10–12 and the pump inlet fluid is represented in standard cross-hatching. The drawing is intended to provide only an understanding of the path of flow relative to the drawing of the tool set forth in FIGS. 10–12. By providing the pathway illustrated, the pressure transducer 146 is exposed to the high pressure fluid from the pump while allowing for easy assembly of the device. More particularly, the pathway provided allows the transducer to be positioned more uphole to make the tool easier to assemble and avoid additional electrical or optic fiber connections. The pathway can be seen in FIGS. 10–12 by noting port 166 which communicates with port 168 which then intersects bore 162. The bore 162 extends uphole to annulus opening 170 which then opens to pressure transducer 146.

Snubber valve 172 operates to vent any trapped air to allow the pump to quickly prime and port plug 174 operates to provide a visual inspection of the pump to insure it is assembled and operates correctly.

From downhole of port 166, the tool is as described in the hereinbefore incorporated patent and the commercial tool noted with the exception that the filter in those tools is specially made whereas the filters 176 of this tool are "off-the-shelf" corrugated filters and have been substituted in the same space as the single custom filter of the prior art. More filter surface area has been provided and the tool is less expensive to assemble.

It should be understood that the capability of the invention is for fully automated operation. Sensors may easily be incorporated for other parameters of the wellbore that are relevant to inflation or even those that are not relevant to inflation of the downhole inflatable tool. All of the information gained by such sensors is processed by the controller which may be a basic-type control unit or a highly intelligent unit capable of understanding and processing all sensory input on well parameters and executing commands based upon such sensing input. All functions are executable downhole without surface intervention of any kind if desired.

While preferred embodiments have been shown and described, various modifications and substitutions may be made thereto without departing from the spirit and scope of the invention. Accordingly, it is to be understood that the present invention has been described by way of illustration and not limitation.

What is claimed:

1. A wireline setting tool comprising:

a housing;

a controller mounted in said housing;

a pump mounted in said housing and operably connected to said controller;

an inlet in said housing, said inlet being connected to said pump and connectable to a fluid source; and an outlet in said housing connected to said pump and connectable to a downhole tool to be set.

2. A wireline setting tool as claimed in claim 1 wherein said sensor is communicatively connected to said controller.

3. A wireline setting tool as claimed in claim 2 wherein said at least one sensor is a plurality of sensors.

4. A wireline setting tool as claimed in claim 3 wherein said plurality of sensors includes sensors to sense at least one of temperature, pressure, flow rate and water cut.

5. A wireline setting tool as claimed in claim 1 wherein said controller further includes communications capability with remote locations.

6. A wireline setting tool as claimed in claim 5 wherein said communications capability with said remote locations is two-way communications.

7. A wireline setting tool as claimed in claim 1 wherein said controller receives information from said at least one sensor, said controller evaluating said information and determining an action to be taken by the tool.

8. A wireline setting tool as claimed in claim 1 wherein at least one fluid parameter sensor is a temperature sensor in contact with an inflation fluid, said tool having an additional sensor in contact with borehole fluid.

9. A wireline setting tool as claimed in claim 8 wherein said at least one fluid parameter sensor senses inflate pressure in an inflatable element in operable communication with said tool and said controller determines an appropriate gear.

10. A wireline setting tool as claimed in claim 7 wherein said controler monitors and executes all functions of said tool without surface intervention.

11. A method for setting an inflatable element downhole in a hydrocarbon well comprising:

running a setting tool in a wellbore;

sensing at least one parameter downhole;

determining inflation volume required; and inflating said inflatable element.

12. A wireline setting tool as claimed in claim 11 wherein said sensing includes monitoring inflate fluid temperature in situ and allowing said fluid to stabilize at well temperature prior to inflating said inflatable element.

13. A wireline setting tool as claimed in claim 11 wherein said sensing includes:

monitoring downhole temperature and a volume of inflation fluid at a surface location;

calculating a thermal expansion of said fluid;

determining an appropriate amount of fluid to inflate said element; and applying fluid to said element in accordance with said calculation and determination.

14. A wireline setting tool as claimed in claim 11 wherein said sensing comprises:

sensing at least one of voltage and current at said setting tool;

sensing at least one of voltage and current at a surface location;

determining condition of a wireline and said setting tool.

15. A wireline setting tool as claimed in claim 14 wherein said method further comprises adjusting at least one of current and voltage at a surface location based upon sensed current and voltage downhole.

16. A method for setting an inflatable element as claimed in claim 11 wherein said running is through a tubing string of said well.

* * * * *